United States Patent [19]

Kaiser

[11] 4,327,901

[45] May 4, 1982

[54] MELT AND HOLD FURNACE FOR NON-FERROUS METALS

[76] Inventor: George S. Kaiser, 18921 Valley Dr., Villa Park, Calif. 92667

[21] Appl. No.: 128,668

[22] Filed: Mar. 10, 1980

[51] Int. Cl.[3] ..... C21C 7/00

[52] U.S. Cl. ..... 266/217

[58] Field of Search ..... 266/217

[56] References Cited

U.S. PATENT DOCUMENTS

| | | | |
|---|---|---|---|
| Re. 21,332 | 1/1940 | Mader | 266/33 |
| 1,683,343 | 8/1928 | Lanigan | 266/33 |
| 2,331,887 | 10/1943 | Bonsack | 266/33 |
| 2,385,333 | 9/1945 | Clapp | 266/33 |
| 2,497,125 | 2/1950 | Hulme | 266/33 |
| 2,939,899 | 6/1960 | Edstrand | 266/200 |
| 4,055,334 | 10/1977 | Stephens | 266/138 |

*Primary Examiner*—P. D. Rosenberg
*Attorney, Agent, or Firm*—Walter A. Hackler

[57] ABSTRACT

A melt and hold furnace includes a melt and hold chamber configured for containing a molten metal bath and having a tap for withdrawing molten metal and a preheat hearth disposed above a top surface of the molten metal bath. A sealed combustion chamber is disposed above the melt and hold chamber and is separated therefrom by radiation plates for radiating heat into the molten metal and hearth. Disposed in an operative relationship with the combustion chamber is a recouperative type burner for causing unimpeded circulation of hot combustion exhaust gases over the radiation plates from the burner and return to exhaust ports disposed within the burner. Conduits, passing through the combustion chamber and into the molten metal provides additional heating of the metal by heat conduction and the introduction of hot non-oxidizing gas into the metal. The gas bubbles through the molten metal enhancing convective heat transfer within the metal as well as purifying the metal and protecting the metal from contact with combustion exhaust gas and the atmosphere.

12 Claims, 2 Drawing Figures

MELT AND HOLD FURNACE FOR NON-FERROUS METALS

Figure 1:
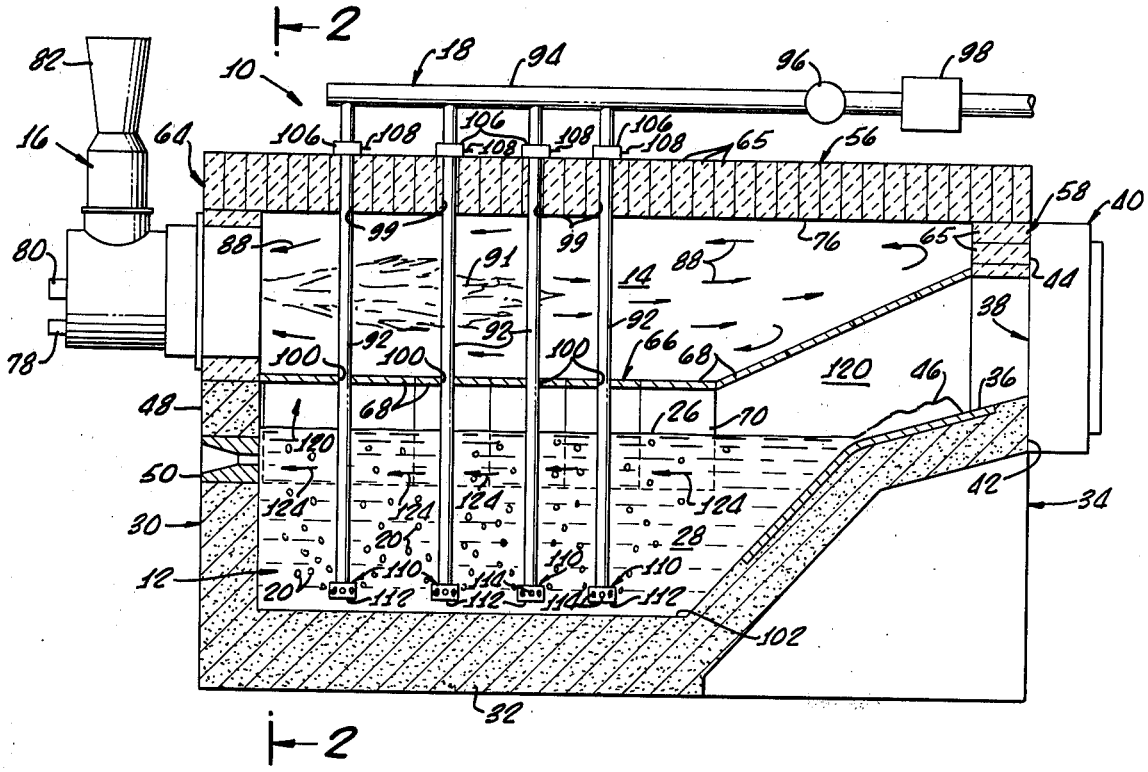

The present invention relates generally to melt and hold furnaces and more particularly to melt and hold furnaces for non-ferrous metals such as aluminum, zinc, and the like.

Generally, non-ferrous metal melt and hold furnaces are heated by electricity or combustable fuels such as natural gas, propane, or oil. Electric furnaces are relatively clean because there are no combustion products which may contact hot or molten metal and cause oxidation or contamination thereof. However, such electric furnaces are generally expensive to operate and not economical when compared to gas fuel fired furnaces.

In a conventional oil or gas fired furnace, a burner typically fires directly over the surface of a molten metal bath. The combustion products and uncombusted fuel come into contact with the molten metal and usually cause oxidation and contamination of the metal. Such oxidation and contamination represents a loss of usable metal, and, in the case of aluminum, may amount to five (5) percent, by weight, of the processed metal. In addition, significant effort may be required to remove such contamination, or impurities, from the metal.

Importantly, conventional gas fired furnaces usually do not circulate the hot combustion products over the metal bath as this procedure may result in lower combustion zone temperatures as well as additional metal contamination. Consequently, because the combustion gases are directly exhausted to the atmosphere, significant energy loss occurs as well as undesirable air pollution and noise.

Clapp, et. al., in U.S. Pat. No. 2,385,333, dated Sept. 25, 1945, recognized the benefits of separating the combustion chamber of a melt and hold furnace from the molten metal, and provided a heat-conductive refractory wall separating the combustion chamber from the molten metal. The refractory wall was designed to float on the molten metal to enhance conduction from the combustion chamber to the molten metal, the combustion chamber being disposed above the molten metal bath. This arrangement significantly reduces metal contamination and oxidation, however, it is impractical because of the maintenance difficulty in replacing or cleaning the floating wall which is necessary from time to time.

Because of the low heat conductivity of many molten metals, such as aluminum, the molten metal surface usually must be held at temperatures significantly above the melting point or the metal in order to keep the entire bath of metal in a molten state. This results in energy waste and lower furnace efficiency.

In order to more uniformly heat a molten metal bath, many designers have provided heat conductive plates which extend into the bath. Such conductive plates generally are in contact with either the combustion chamber or with the surface of the molten metal. The use of such conduction plates enhances the uniformity of molten metal bath heating, however, additional means are necessary, and heretofore not available, to further improve molten metal bath heating and thereby further improve melt and hold furnace efficiency.

The present invention provides a melt and hold furnace having a combustion chamber separated from a molten metal bath in order to eliminate contact of combustion products with molten metal. A hot non-oxidizing gas, such as nitrogen, chlorine, or a mixture thereof, is introduced into the molten metal bath in order to enhanced heat transfer within the bath by agitation thereof, to introduce additional heat below the surface of the molten metal and to remove impurities from one molten metal.

Such agitation promotes convective heat transfer of the molten metal from lower levels of the bath (where the metal temperature is relatively low) to the surface of the bath (where the metal temperature is relatively high).

A melt and hold furnace in accordance with the present invention includes a melt and hold chamber with a preheat hearth and outlet means for drawing molten metal from the melt and hold chamber. The preheat hearth has an inlet for introducing solid metal thereinto. A sealed combustion chamber is provided which is proximate the melt and hold chamber and is separated therefrom by radiation plates which prevent combustion products from contacting the molten metal and also radiate heat from the combustion chamber into the melt and hold chamber. The radiation plates are spaced apart from the molten metal to enable a nonoxidizing gas to cover and envelope the molten metal to further reduce contamination of the metal. Non-oxidizing gas means are provided for promoting circulation of the molten metal within the melt and hold chamber.

More particularity, the non-oxidizing gas means includes a plurality of spaced apart conduits passing through the combustion chamber. The conduits are comprised of a heat combustion material and consequently conduct additional heat from the combustion chamber into the metal as well as enable the non-oxidizing gas to be preheated by the combustion chamber heat, the preheated gas causing additional heating of the metal below a top surface thereon.

A recouperative type burner assembly is mounted to the combustion chamber for causing combustion within the combustion chamber. The recouperative type burner assembly is disposed in an operative relationship with the combustion chamber for causing unimpeded circulation of the combustion exhaust gases over the radiation plates from the burner and return to exhaust ports disposed within the burner assembly.

Figure 2:
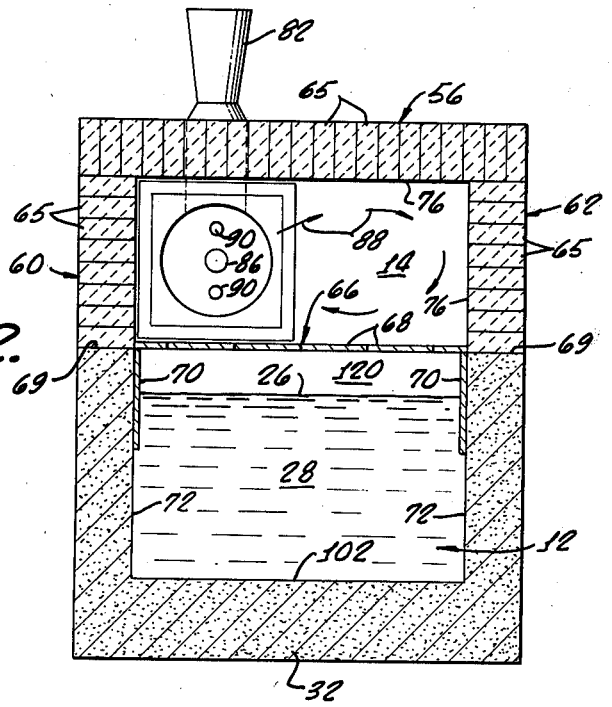

The foregoing and other features and advantages will be apparent in the following specification describing the invention, taken in conjunction with the accompanying drawings in which:

FIG. 1 is a cross-section elevation view of a melt and hold furnace in accordance with the present invention showing a combustion chamber separated from a melt and hold chamber by a set of radiation plates. Also shown is a recouperative burner and a preheat hearth; and, FIG. 2 is an end view of the melt and hold furnace taken along line 2—2 showing the operative relationship of the recouperative burner with the combustion chamber for causing unimpeded circulation of combustion exhaust gases over the radiation plates.

Turning now to FIG. 1, a melt and hold furnace 10, in accordance with the present invention generally includes a melt and hold chamber 12, a sealed combustion chamber 14, a recouperative type burner 16 and conduit apparatus 18, or means, for introducing a non-oxidizing gas 20, such as nitrogen or chlorine, beneath a top surface 26 of molten metal 28, which may be for example, aluminum, contained within the melt and hold chamber 12.

The melt and hold chamber 12 may be generally rectangular and have a lower portion 30 constructed of a dense refractory material 32 of thickness sufficient to support and contain the metal 28 with low heat energy loss as is well known in the art. The capacity of the melt and hold chamber may be, for example, 16,000 pounds.

At one end 34 of the melt and hold chamber 12 there is a preheat area, or hearth, 36 which may be inlaid silicon carbide, and an inlet, or opening, 38 in communication with the hearth 36 for introducing solid metal 46 thereonto. A movable door 40, configured for sealing the melt and hold chamber 12, extends between a melt and hold chamber frontal surface 42 and a combustion chamber frontal surface 44. Conventional door movement mechanism, not shown, enables access to the inlet 38 and hearth 36.

An opposite end 48 of the melt and hold chamber 12 includes a tap 50 for withdrawing molten metal 28 from the chamber 12. As will be subsequently discussed in greater detail, the drawing of molten metal 28 from the melt and hold chamber 12 enhances molten metal contact with the gas 20. Alternatively, as well known in the art, the tap 50 may be replaced by a dipping well, not shown.

Disposed above the melt and hold chamber 12 and supported thereby, the sealed combustion chamber 14 includes a top 56, a front 58, sides 60, 62 and back 64 formed from a plurality of commercially available ceramic fiber blocks 65, such as, for example, "pyro-bloc" available from Sauder Industries, Des Plaines, Ill., and interconnected as well known in the art. Depending on the desired combustion chamber 14 temperature, as for example 2300 to 2500° F., the ceramic block thickness may be approximately 12 inches. Additionally, as is well known, other high temperature corrosion resistant materials, not shown, may be secured to an inner surface 76 of the ceramic blocks 65 to enhance the life of the combustion chamber 14. The use of the ceramic fiber blocks 65 enables modular construction of the combustion chamber 14 and ease of replacement and/or repair of the combustion chamber.

The combustion chamber 14 is sealed and separated from the melt and hold chamber 12 by a combustion chamber bottom 66 formed from a plurality of radiation plates 68. It is to be appreciated that the plates 68 may be formed of silicon carbide in the shape of bricks, rods, bars or sealed tubes appropriately interconnected and supported from a top surface 69.

To provide additional heating of the molten metal 28, silicon carbide conduction plates 70 extending from the combustion chamber bottom 66 and in contact therewith may be provided along an inner surface 72 of the melt and hold chamber 12.

The recouperative burner 16 may have an output of 1,500,000 BTU/hour and is commercially available from Hotwork, Inc. of Lexington, Ky., the burner 16 being mounted to the combustion chamber back 64 by means of bolts, not shown. Briefly, the recouperative type burner 16 includes a fuel inlet 78, for oil or gas, a combustion air inlet 80 and an exhaust stack 82. Combustion air and fuel are mixed by a nozzle 86 (FIG. 2) and expelled into the combustion chamber 14 for combustion therein.

Importantly, the burner 16 is disposed proximate the side 60 of the combustion chamber 14 for causing circulation of hot combustion exhaust gases, as indicated by arrows 88 over the radiation plates 68 from the burner nozzle 86 to exhaust ports 90 disposed within the burner 16. By disposing the burner 16 proximate the combustion chamber side 60, the combustion gases have a circulation route (out along the chamber side 60 and back along the chamber side 62) which is unimpeded by a burner flame 91. This circulation of the hot combustion exhaust gases within the combustion chamber 14 and over the radiation plates 68 increases the time the exhaust gases spend within the combustion chamber and hence enables greater heating of the radiation plates 68 than otherwise possible with conventional furnace combustion chambers, not shown, having an exhaust outlet spaced apart from a burner nozzle.

The conduit apparatus 18 generally includes one or a plurality of pipes, or tubes, 92 dispersed within the furnace 10 and interconnected by a manifold 94 which in turn communicates with a pressurized gas supply, not shown, through a conventional control valve 96. A flow meter 98 may be provided in order to monitor the flow of gas 20 into the molten metal 28 to insure that sufficient pressure is provided to enable the gas 20 to bubble through the molten metal 28.

The gas bubbles 20 cause agitation of the molten metal 28 and enhance convection heat transfer within the molten metal. Such convection provides a more uniform molten metal temperature, and improves furnace efficiency by reducing the temperature gradient between the molten metal top surface 26 and molten metal proximate a bottom surface 102 and the side surfaces 72 of the melt and hold chamber 12.

Holes 99, 100 through the combustion chamber top 56 and radiation plates 68, respectively, enable the tubes 92 to pass through the combustion chamber 14 and into the metal 28 well below the surface 26 thereof. A set of collets 106 having set screws 108 are provided to support the tubes 92 within the furnace 10, enable adjustment of the depth of tube outlets, or ends, 110 below the molten metal surface 26, and facilitate replacement of the tubes 92.

In order to enhance the dispersion of the gas 20 within the molten metal 28, gas diffusers 112 may be screwed or attached to the tubes 92. Preferably, the tubes 92 and the diffusers 112 are formed of a heat conductive material such as silicon carbide, or the like, in order to conduct additional heat into the molten metal 28 from the combustion chamber 14.

The diffusers 112 may have a larger diameter than the tubes 92 and include holes, or perforations, 114 to enhance dispersion, or bubbling, of the gas 20 within the molten metal 28. The gas bubbles interact with the molten metal to remove impurities in a well known manner, for example, chlorine is effective in removing magnesium impurities from aluminum. In addition, as the gas bubbles 20 rise to the top surface 26 they form a blanket, or cover, over the surface 26 and hearth 36 which purges oxygen from a space 120 between the top surface 26, hearth 36 and the combustion chamber bottom 66 which may be introduced when solid metal 46 is introduced onto the hearth 36. A positive pressure, compared to atmospheric and combustion chamber 14 pressure, within the space 120 prevents oxygen from leaking into the melt and hold chamber 12 through the door 40 and surfaces 42, 44 or any crack, not shown, which may be present or occur in the combustion chamber bottom 66. This positive gas pressure also prevents any combustion exhaust gases from passing between the tubes 92 and the holes 100 and entering the space 120 thereby insuring isolation of the molten metal 28 from the combustion exhaust gases.

As previously mentioned, the tap 50 is disposed in operative relationship with the melt and hold chamber 12 for enhancing molten metal contact with the gas bubbles 20. This enhancement occurs because as the molten metal 28 is withdrawn from the melt and hold chamber 12 in the direction of arrows 124, it passes through, and intermingles with, the gas bubbles 20 as they rise to the surface 26.

It is important that the tubes 92 pass through the combustion chamber 14 to enable heating of the non-oxidizing gas 20. Although the gas may be separately heated, such procedures reduce the overall efficiency of the furnace 10.

Although there has been described hereinabove a particular arrangement of a melt and hold furnace for the purpose of illustrating the manner in which the invention may be used to advantage, it should be appreciated that the invention is not limited thereto. Accordingly, any and all modifications, variations or equivalent arrangements which may occur to those skilled in the art, should be considered to be within the scope of the invention as defined in the appended claims.

What is claimed is:

1. A melt and hold furnace for non-ferrous metals comprising:

(a) a melt and hold chamber including a preheat hearth and outlet means for drawing molten metal from said melt and hold chamber, said preheat hearth having an inlet means for introducing solid metal into said preheat hearth;

(b) a sealed combustion chamber proximate said melt and hold chamber and separated therefrom by radiation plate means for preventing combustion products from contacting the molten metal and for radiating heat from the combustion chamber into the melt and hold chamber to melt metal therein said radiation plate means being spaced apart from the molten metal; and, (c) non-oxidizing gas means for promoting convection heat transfer within the molten metal.

2. A melt and hold furnace for non-ferrous metals comprising:

(a) a melt and hold chamber including a preheat hearth and outlet means for drawing molten metal from said melt and hold chamber, said preheat hearth having an inlet means for introducing solid metal into said preheat hearth;

(b) a sealed combustion chamber proximate said melt and hold chamber and separated therefrom by radiation plate means for preventing combustion products from contacting the molten metal and for radiating heat from the combustion chamber into the melt and hold chamber, said radiation plate means being spaced apart from the molten metal;

(c) means for introducing a non-oxidizing gas beneath a surface of the molten metal at a pressure sufficient to enable the gas to bubble through the molten metal; and, (d) means for preheating the non-oxidizing gas before introduction thereof into the molten metal.

3. The melt and hold furnace according to claim 2 wherein the means for preheating the non-oxidizing gas includes at least one conduit passing through the combustion chamber.

4. The melt and hold furnace according the claim 2 wherein the means for preheating the non-oxidizing gas includes a plurality of spaced apart conduits passing through the combustion chamber, said plurality of conduits being interconnected by a manifold.

5. The melt and hold furnace according to claim 3 or 4 wherein each conduit includes means for conducting heat from the combustion chamber into the molten metal.

6. A melt and hold furnace for non-ferrous metals comprising:

(a) a melt and hold chamber including a preheat hearth and outlet means for drawing molten metal from said melt and hold chamber, said preheat hearth having an inlet means for introducing solid metal into said preheat hearth;

(b) a sealed combustion chamber proximate said melt and hold chamber and separated therefrom by radiation plate for preventing combustion products from contacting the molten metal and for radiating heat from the combustion chamber into the melt and hold chamber, said radiation plate means being spaced apart from the molten metal; and, (c) conduit means for introducing a non-oxidizing gas beneath a surface of the molten metal, said non-oxidizing gas being at a pressure sufficient to enable the gas to bubble through the molten metal and cover the molten metal and hearth, said conduit means being comprised of a heat conductive material and passing through the combustion chamber and into the molten metal.

7. The melt and hold furnace according to claim 2 or 6 further comprising a recouperative type burner for causing combustion within the combustion chamber wherein combustion exhaust gases preheat incoming air to the burner, said disposed in an operative relationship with the combustion chamber for causing unimpeded circulation of the combustion exhaust gases over the radiation plate means from the burner and return to exhaust ports disposed within the burner.

8. A melt and hold furnace for non-ferrous metals comprising:

(a) a melt and hold chamber including a preheat hearth and outlet means for drawing molten metal from said melt and hold chamber, said preheat hearth having an inlet means for introducing solid metal into said preheat hearth;

(b) a sealed combustion chamber proximate said melt and hold chamber and separated therefrom by radiation plate means for preventing combustion products from entering the melt and hold chamber and for radiating heat from the combustion chamber into the melt and hold chamber and hearth, said radiation plate means being spaced apart from the molten metal and said hearth; and, (c) conduit means for introducing a non-oxidizing gas beneath a surface of the molten metal, said non-oxidizing gas being at a pressure sufficient to enable the gas to bubble through the molten metal and cover the molten metal and hearth, said conduit means being comprised of a heat conductive material and passing through the combustion chamber and into the molten metal, thereby conducting heat from the combustion chamber into the molten metal.

9. A melt and hold furnace for non-ferrous metals comprising:

(a) a melt and hold chamber including a preheat hearth and outlet means for drawing molten metal from said melt and hold chamber, said preheat hearth having an inlet means for introducing solid metal into said preheat hearth;

(b) a sealed combustion chamber proximate said melt and hold chamber and separated therefrom by radiation plate means for preventing combustion products from entering the melt and hold chamber and for radiation heat from the combustion chamber into the melt and hold chamber and hearth, said radiation plate means being spaced apart from the molten metal and said hearth;

(c) a recouperative type burner removably mounted to said combustion chamber for causing combustion within the combustion chamber wherein combustion exhaust gases preheat incoming air to the burner, said recouperative type burner being disposed in an operative relationship with the combustion chamber for causing unimpeded circulation of the combustion exhaust gases over the radiation plate means from the burner and return to exhaust ports disposed within the burner;

(d) conduit means for introducing a non-oxidizing gas beneath a surface of the molten metal, said non-oxidizing gas being at a pressure sufficient to enable the gas to bubble through the molten metal and cover the molten metal and hearth, said conduit means being comprised of a heat conductive material and passing through the combustion chamber and into the molten metal, thereby conducting heat from the combustion chamber into the molten metal.

10. A melt and hold furnace for non-ferrous metals comprising:

(a) a melt and hold chamber configured for containing a molten metal bath and including outlet means for drawing molten metal from said melt and hold chamber and a preheat hearth disposed above a top surface of the molten metal bath, said preheat hearth having an inlet means for introducing solid metal into said preheat hearth;

(b) a sealed combustion chamber proximate said melt and hold chamber and separated therefrom by radiation plate means for preventing combustion products from entering the melt and hold chamber and for radiating heat from the combustion chamber into the melt and hold chamber and hearth, said radiation plate means being spaced apart from the molten metal and said hearth;

(c) a recouperative type burner removably mounted to said combustion chamber for causing combustion within the combustion chamber wherein combustion exhaust gases preheat incoming air to the burner, said recouperative type burner being disposed in an operative relationship with the combustion chamber for causing unimpeded circulation of the combustion exhaust gases over the radiation plate means from the burner and return to exhaust ports disposed within the burner; and, (d) conduit means for introducing a non-oxidizing gas beneath the top surface of the molten metal bath, said non-oxidizing gas being at a pressure sufficient to enable the gas to bubble through the molten metal bath and cover the molten metal bath top surface and hearth, said conduit means being comprised of a heat conductive material and passing through the combustion chamber and into the molten metal, thereby conducting heat from the combustion chamber into the molten metal.

11. A melt and hold furnace for non-ferrous metals comprising:

(a) a sealed combustion chamber having a bottom surface for radiating heat therefrom;

(b) a recouperative type burner mounted to said combustion for causing combustion with the combustion chamber, said recouperative type burner being disposed in an operative relationship with the combustion chamber for causing unimpeded circulation of the exhaust gases within the sealed combustion chamber;

(c) a melt and hold chamber configured for containing a molten metal bath and including a preheat hearth having an inlet means for introducing solid metal into said preheat hearth, said melt and hold chamber being disposed below the sealed combustion chamber for receiving heat radiation from a combustion chamber bottom surface;

(d) conduit means including an outlet, for introducing a non-oxidizing gas beneath a top surface of the molten metal bath, said non-oxidizing gas being at a pressure sufficient to enable the gas to bubble out of the outlet and through the molten metal bath; and, (e) outlet means in operative relationship with the melt and hold chamber for drawing molten metal therefrom and enhancing molten metal contact with the non-oxidizing gas.

12. The melt and hold furnace according to claim 9, 10, or 11 wherein the conduit means includes diffusing means for dispersing the non-oxidizing gas within the molten metal.

* * * * *